United States Patent [19]

Calcerano

[11] Patent Number: 4,825,624

[45] Date of Patent: May 2, 1989

[54] MODULAR PROMOTIONAL DISPLAY

[75] Inventor: Victor Calcerano, Carmel, N.Y.

[73] Assignee: Duracell Inc., Bethel, Conn.

[21] Appl. No.: 125,414

[22] Filed: Nov. 25, 1987

[51] Int. Cl.[4] ..... B65B 35/50; B65B 53/02

[52] U.S. Cl. ..... 53/442; 53/447; 53/449; 206/44 R

[58] Field of Search ..... 53/442, 449, 447, 171; 206/44 R, 45.28

[56] References Cited

U.S. PATENT DOCUMENTS

| | | | |
|---|---|---|---|
| 2,178,091 | 10/1959 | Weiss | 206/44 R |
| 2,964,169 | 12/1960 | Brachman | 206/44 R |
| 3,100,642 | 8/1963 | Cordstein | 206/44 R |
| 3,305,078 | 2/1967 | Ferrera | 206/44 R |
| 3,999,357 | 12/1976 | Marantz | 53/442 |
| 4,116,330 | 9/1978 | Ellis | 206/44 R |
| 4,363,400 | 12/1982 | Lewis | 206/44 R |

FOREIGN PATENT DOCUMENTS

| | | | |
|---|---|---|---|
| WO81/01232 | 5/1981 | PCT Int'l Appl. | 206/45.28 |

*Primary Examiner*—John Sipos

*Attorney, Agent, or Firm*—Ronald S. Cornell; James B. McVeigh

[57] ABSTRACT

This invention relates to a modular promotional display for blister card battery packages. The blister card packages are loaded into a multicompartmented module at the manufacturing point. The filled modules are shipped to the promotional display assembly point where a plurality of modules are placed into a display tray. Thus, the modules serve as both a shipping container and a display container for the batteries.

6 Claims, 1 Drawing Sheet

MODULAR PROMOTIONAL DISPLAY

This invention relates to a modular promotional display wherein the articles for display and sale are loaded into modules at the manufacturing point. The loaded modules are shipped to the promotional display assembly point where they are easily incorporated into the display. Thus, the modules serve as both the shipping container and the display container.

In particular, the present invention relates to a modular display for batteries contained in blister cards. Each module is rectangular in shape, has four rectangular walls, a bottom, and a closeable top, and is divided into compartments by appropriately placed divider panels. The size of each compartment is such that a plurality of blister cards can be contained therein. At the manufacturing point the blister card battery packages are loaded into each compartment of a module. The filled modules are loaded onto a pallet, shrink wrapped, and shipped to the promotional display assembly point. The loaded modules are then arranged in display trays appropriately sized to hold a plurality of modules. Thus, a filled promotional display is quickly assembled without individually handling the product at the promotional display assembly point.

Heretofore, it was the practice to bulk pack blister card battery packages in large, bulk shippers at the manufacturing point. The filled bulk shippers would be shipped to the promotional display assembly point where the product would be individually handled to load the promotional display. The promotional display assembly would be comprised of a tray or trays having a plurality of compartments and the product would be unloaded from the bulk shipper and loaded individually into the compartments. The empty bulk shippers have either been discarded or sent back to the manufacturing point, both options involving appreciable cost.

The present invention eliminates the need of bulk shippers, and results in a cost savings resulting from eliminating buying, warehousing, and reshipping empty bulk shippers. A savings in labor is also realized because double handling of blister cards is eliminated.

The features and advantages of the present invention will be discussed with reference to the drawings in which.

Figure 2:
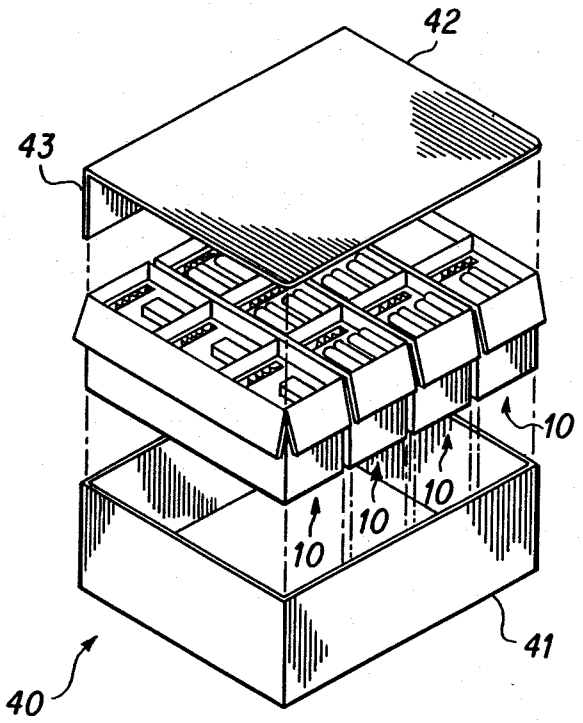
FIG. 2 is an exploded-view diagram of a promotional display assembly containing several modules.
Figure 1:
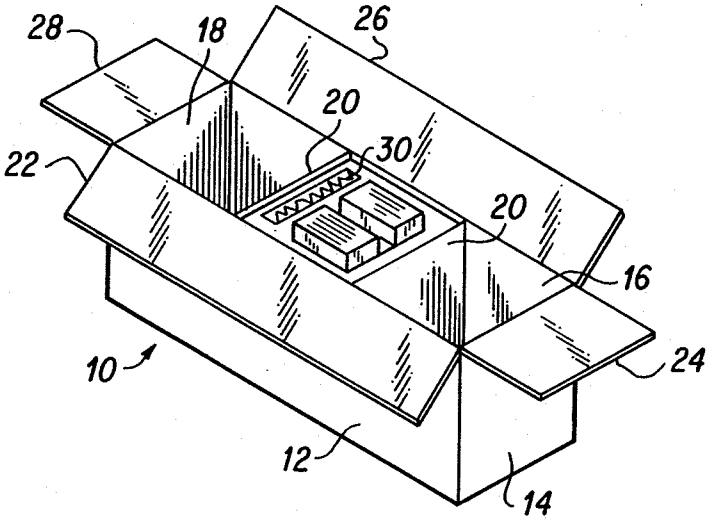
FIG. 1 shows a module made in accordance with the invention.

Referring now to the FIG. 1 of the drawings, a modular promotional display is comprised of a plurality of modules 10. Each module 10 is comprised of four walls 12, 14, 16, 18 and divider panels 20. The divider panels 20 divide the space within modules 10 into compartments which are preferably of equal size. The dimensions of the walls 12, 14, 16, 18 and the placement of the dividers 20 are such that the compartments will closely hold a plurality of blister card battery packages 30 stacked therein. It is preferred that the blister cards 30 are stacked into the compartments as shown in FIGS. 1 and 2 in order to easily view the graphics on the front of the blister card when looking down onto the module. Further, the blister cards 30 in each compartment should be oriented as shown in FIG. 2 so that the graphics on the blister cards in each compartment are in the same direction.

Flaps 22, 24, 26, and 28 are attached by their edges to the upper edges of walls 12, 14, 16, and 18 respectively, as shown in FIG. 1. These flaps form the closeable top of the module. Similar flaps, not shown, are attached to the lower edges of walls 12, 14, 16, and 18 and form the bottom of the module. The flaps which form the bottom are closed in essentially permanent fashion, by conventional means such as staples, glue, or adhesive tape. The compartments of the module are loaded with the blister cards and the top flaps 22, 24, 26, and 28 are closed in a non-permanent fashion by suitable means such as pressure sensitive adhesive tape. The closed modules are loaded onto a pallet, shrink wrapped in plastic, and shipped to the promotional display assembly point. After the loaded modules are received at the promotional display assembly point their tops are opened and top flaps 22, 24, 26, and 28 are folded back against the outer surface of sides 12, 14, 16, and 18, as shown in FIG. 2, and the modules 10 are placed into a display tray 41. Thus, a promotional display having twelve filled compartments is obtained without having to individually handle the blister cards at the place of assembly.

A top member 42 is attached to the tray 41 to close the open modules during shipping to the retail outlet. Member 42 has flap 43 foldably attached at one edge wherein flap 43 can be inserted between the modules 10 and one side of the tray 41 so that to member 42 folds down and over the modules as shown. At the retail outlet the top 42 is opened and the promotional display is set up. The inside surface of top 42 preferably has appropriate graphics thereon, so that when the display is placed upright after it is opened the graphics are visible to the consumer for identifying and promoting the product.

The module 10 can be fabricated from any of the materials commonly used in the packaging art. Such materials include corrugated cardboard, heavy paperboard, corrugated plastic, molded plastic, and thermoformed plastic. The plastic materials are generally more rugged but are also more expensive and would need to be re-used to be cost effective. It is generally desirable that the modules be disposable, whereby reshipping costs are avoided. Thus, it is preferred to fabricate the modules from a cheaper material such as corrugated cardboard or heavy paperboard. Corrugated cardboard is the most preferred material because it has a greater inherent strength than heavy paperboard. Of the corrugated cardboards E flute corrugated cardboard is the most preferred because this material makes it easier to mechanically form and glue the module together from a single piece of cardboard. It is desirable to fabricate the module from a single piece of cardboard because this makes it easier to mechanically assemble the module.

The features of the present invention will be demonstrated in the following example.

EXAMPLE 1

A module for displaying blister card packages, each containing 2 D size cells, is fabricated from a single piece of E fluted corrugated cardboard. The module is 14 inches long, 4 inches wide, and 8 inches high, thus the side panels are 14 inches long and 8 inches high and the end panels are 4 inches long by 8 inches high. The bottom of the module is comprised of two flaps 14 inches long and 2 inches wide, each flap being foldably attached to the lower edge of one side panel; and two flaps 4 inches long and two inches wide, each flap being foldably attached to the lower edge of one end panel. These bottom flaps are folded towards each other until they are at 90 degrees to the sides and ends of the module and are taped in position to form the bottom of the module.

Two divider panels are each 4 inches long and 8 inches high and are located inside the module parallel to the end panels. The divider panels are located so as to divide the interior of the module into three equally sized compartments. Six blister card packages containing 2 D size cells are placed into each compartment. The graphics on each blister card face up such that all three compartments have the graphics facing up and oriented in the same direction.

The top of the module is comprised of two flaps 14 inches long and 4 inches wide, each being foldably attached to the upper edge of one side panel; and two flaps 4 inches long and 4 inches wide, each being foldably attached to the upper edges of one end panel. After the blister card packages are loaded in the compartments the two end flaps are folded in, a first side flap is folded in and over the end flaps, and a second side flap is folded in over the first side flap and taped in position. A plurality of modules are thus assembled and loaded onto a pallet. A plastic film is wrapped around the module-filled pallet and the film is heat shrunk so that the modules are firmly held. The loaded pallet is then shipped to the promotional display assembly point.

The modular promotional display is assembled by placing four loaded modules side by side into a display tray 16 inches long, 14 inches wide and 8 inches high. The modules first have the tops untaped and the top flaps folded back against the sides and ends of the module. The modules are then inserted into the tray side by side such that the flaps are all held against the sides of the modules. A tray having twelve filled compartments is thus obtained. A top measuring 16 inches long and 14 inches has a 3 inch wide flap foldably attached. The flap is inserted between the modules and one side of the tray such that the top folds down over the modules. The inside surface of the top has promotional graphics located thereon. The completed promotional display assemblies are sent to the retail outlets where the top is folded up to display the graphics in conjunction with displaying the blister card battery packages.

While the above example relates to a modular display for D size cells it is clear that the same type of display can be made for C, AA, AAA, 9 V, and other battery sizes. Further a single display tray could contain modules having compartments filled with different battery sizes.

Significant cost savings can be obtained by using the modular display packaging of the present invention. Bulk shippers are eliminated, double handling of the blister cards is eliminated, and the time and labor cost of assembling the displays is reduced.

It is to be understood that deviations can be made from the example and description of the present invention and remain within the scope of the invention as set forth in the claims.

What is claimed is:

1. A method for assembling a modular promotional display having a plurality of rectangular, multicompartmented modules for the display and sale of articles comprising stacking a first individual module with a plurality of identical articles, stacking at least one different module with a plurality of identical articles different from those stacked in said first module, and stacking the remaining modules with articles such that each module contains substantially identical articles, and wherein each module comprises an integral closeable top; closing said modules; shipping the filled modules to a point of display assembly; opening the modules; and placing a plurality of open modules into a display tray whereby different articles are displayed in the same display tray.

2. The method of 1 wherein the articles comprise blister card battery packages.

3. The method of claim 1 further comprising loading the filled modules onto a pallet and shrink wrapping the loaded pallet prior to shipping to the promotional display assembly point.

4. The method of claim 1 wherein the modules are filled with articles at the manufacturing point.

5. The method of claim 1 further comprising closing the display tray with a cover and shipping the closed display tray to a retail outlet where the articles will be displayed and sold.

6. The method of claim 1 wherein said module comprises a closeable top comprised of four flaps wherein each flap is attached to the upper edge of one side of the module and is foldable along the edge where it is attached; wherein the method further comprises folding the flaps to close the top of the module after the blister cards are stacked therein and unfolding the flaps back against the sides of the module prior to placing the modules in the display tray.

* * * * *